US008757138B2

(12) United States Patent
Shaffer et al.

(10) Patent No.: US 8,757,138 B2
(45) Date of Patent: Jun. 24, 2014

(54) GAS COOKTOP APPARATUS

(75) Inventors: Timothy Scott Shaffer, Louisville, KY (US); Ariel Marie Young, Channohon, IL (US)

(73) Assignee: General Electric Company, Schenectady, NY (US)

( * ) Notice: Subject to any disclaimer, the term of this patent is extended or adjusted under 35 U.S.C. 154(b) by 359 days.

(21) Appl. No.: 12/871,297

(22) Filed: Aug. 30, 2010

(65) Prior Publication Data

US 2012/0048256 A1 Mar. 1, 2012

(51) Int. Cl.
*F24C 3/12* (2006.01)
*F24C 15/10* (2006.01)

(52) U.S. Cl.
CPC ..... *F24C 15/101* (2013.01)
USPC ..... 126/42; 126/39 E

(58) Field of Classification Search
USPC ..... 126/42, 646, 39 H
See application file for complete search history.

(56) References Cited

U.S. PATENT DOCUMENTS

| | | | | | |
|---|---|---|---|---|---|
| 1,452,440 | A * | 4/1923 | Robinson | 126/39 K |
| 1,858,310 | A * | 5/1932 | Sherman | 126/39 B |
| 2,466,979 | A * | 4/1949 | Bauer | 126/214 R |
| 2,497,787 | A * | 2/1950 | Minster | 126/39 N |
| 3,051,817 | A * | 8/1962 | Pearce et al. | 219/452.11 |
| 3,494,350 | A * | 2/1970 | Perl | 126/39 J |
| 3,633,562 | A * | 1/1972 | Morse et al. | 126/39 J |
| 3,645,249 | A * | 2/1972 | Henderson et al. | 126/39 H |
| 3,724,441 | A * | 4/1973 | Finley | 126/38 |
| 3,785,364 | A * | 1/1974 | Reid et al. | 126/39 J |
| 4,551,600 | A * | 11/1985 | Miyagawa et al. | 219/623 |
| 4,665,893 | A * | 5/1987 | Miyagawa et al. | 126/299 D |
| 4,836,181 | A * | 6/1989 | Saga | 126/42 |
| 6,076,517 | A * | 6/2000 | Kahlke et al. | 126/39 J |
| 6,230,701 | B1 * | 5/2001 | Schultheis et al. | 126/39 J |
| 6,252,205 | B1 * | 6/2001 | Schultheis et al. | 219/452.11 |
| 7,690,374 | B2 * | 4/2010 | Lee et al. | 126/39 J |
| 2005/0202361 | A1 * | 9/2005 | Albizuri | 431/354 |
| 2006/0048767 | A1 * | 3/2006 | Lee et al. | 126/214 R |
| 2006/0070616 | A1 * | 4/2006 | Lee et al. | 126/299 D |
| 2006/0254574 | A1 * | 11/2006 | Lee et al. | 126/39 R |

* cited by examiner

*Primary Examiner* — Avinash Savani
*Assistant Examiner* — George R Blum
(74) *Attorney, Agent, or Firm* — Global Patent Operation; Vivek P. Shankam

(57) ABSTRACT

A gas cooktop includes a burner box assembly having a top surface with a plurality of air inlets and gas burners disposed therethrough. A partition is disposed between the top surface and a bottom surface, the partition defining a plurality of segregated air paths that each leading from at least one of the plurality of air inlets to one of the plurality of gas burners.

19 Claims, 7 Drawing Sheets

GAS COOKTOP APPARATUS

BACKGROUND OF THE INVENTION

The present disclosure relates generally to a gas cooktop, and more particularly to a gas cooktop providing combustion air via openings through the cooktop.

In general, gas cooktops are surface cooking systems that include more than one gas surface burner, and may be a stand-alone unit that is mounted, for example upon a kitchen countertop. Operation of the surface burners may be accomplished with burner control knobs located on the cooktop surface. Below each knob, the cooktop may have a control clearance orifice or opening, which may allow air to pass down into the burner box of the cooktop. When a control knob is actuated, fuel is supplied to associated burners and an ignition module may create a spark to ignite the gas and air mixture to produce a flame. The gas burners can sit upon the cooktop and below grates on which cooking utensils are supported.

In a conventional cooktop, when more than one burner is operating, the burners may compete for air provided through the air openings. Air is generally pulled to the burner along the path of least resistance through the openings, resulting in competition between the burners for primary air. The lack of a dedicated air intake for each separate burner in a multiple burner cooktop generally results in an inability of a burner to overcome the negative pressure being induced by the air draw of the other burners. For example, when more than one burner is operating, primary air demand for a burner at a higher setting may tend to overwhelm that of a burner operating at a lower setting, and may even pull air downward through that burner. This may increase a minimum amount of fuel required to sustain a stable flame, such as at a simmer burner for example, than would otherwise be necessary if the other burners are not operated.

Accordingly, it would be desirable to provide a gas cooktop arrangement that overcomes at least some of the problems identified above.

BRIEF DESCRIPTION OF THE INVENTION

As described herein, the exemplary embodiments overcome one or more of the above or other disadvantages known in the art.

One aspect of the disclosed embodiments relates to a gas cooktop. The gas cooktop includes a burner box assembly having a top surface with a plurality of air inlets and gas burners disposed therethrough. A partition is disposed between the top surface and a bottom surface, the partition defining a plurality of segregated air paths that each lead from at least one of the plurality of air inlets to one of the plurality of gas burners.

Another aspect of the disclosed embodiments relates to a gas cooktop including a burner box assembly, a plurality of gas burners, and a plurality of gas control valves. The gas burners are disposed through openings in a top surface of the burner box assembly and are in operative communication with a respective one of the control valves. Each control valve has a corresponding control clearance orifice through the top surface. A partition disposed between the top surface and a bottom surface of the burner box assembly defines a plurality of segregated air paths from each of the control clearance orifices to a corresponding one of the plurality of gas burners. A height of the partition is substantially equal to a distance between the top surface and the bottom surface of the cooktop.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
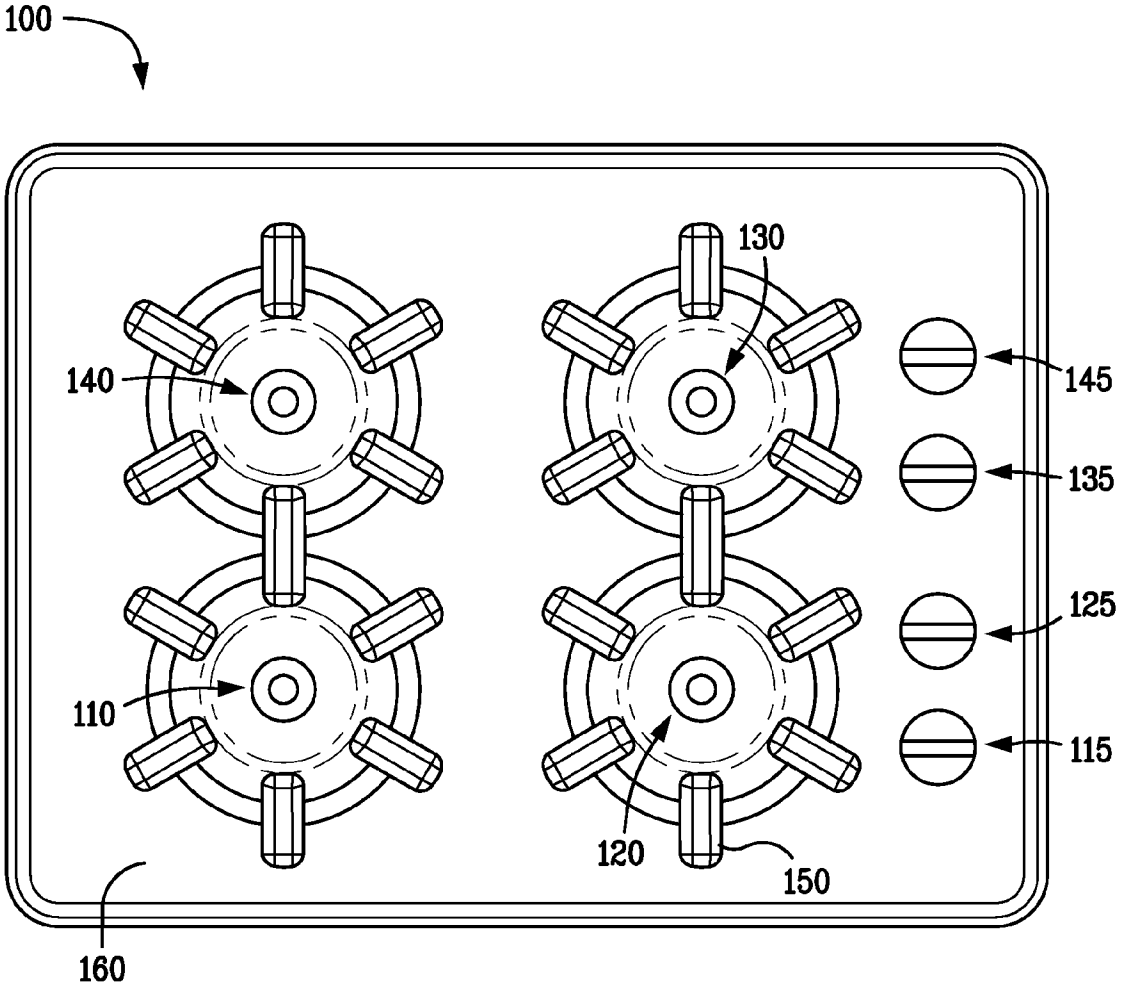
FIG. 1 depicts a top plan view of a gas cooktop in accordance with an embodiment of the present disclosure.

FIG. 1 illustrates a top plan view of an exemplary gas cooking appliance in the form of a gas cooktop 100 in accordance with aspects of the disclosed embodiments. The aspects of the disclosed embodiments are generally directed towards a gas cooktop having a burner box incorporating partitions that isolate the air intake path to each burner. The partitioning separates the air flow paths and reduces the impact between burners with different air flow requirements as compared to a cooktop lacking dedicated air flow paths.

Figure 3:
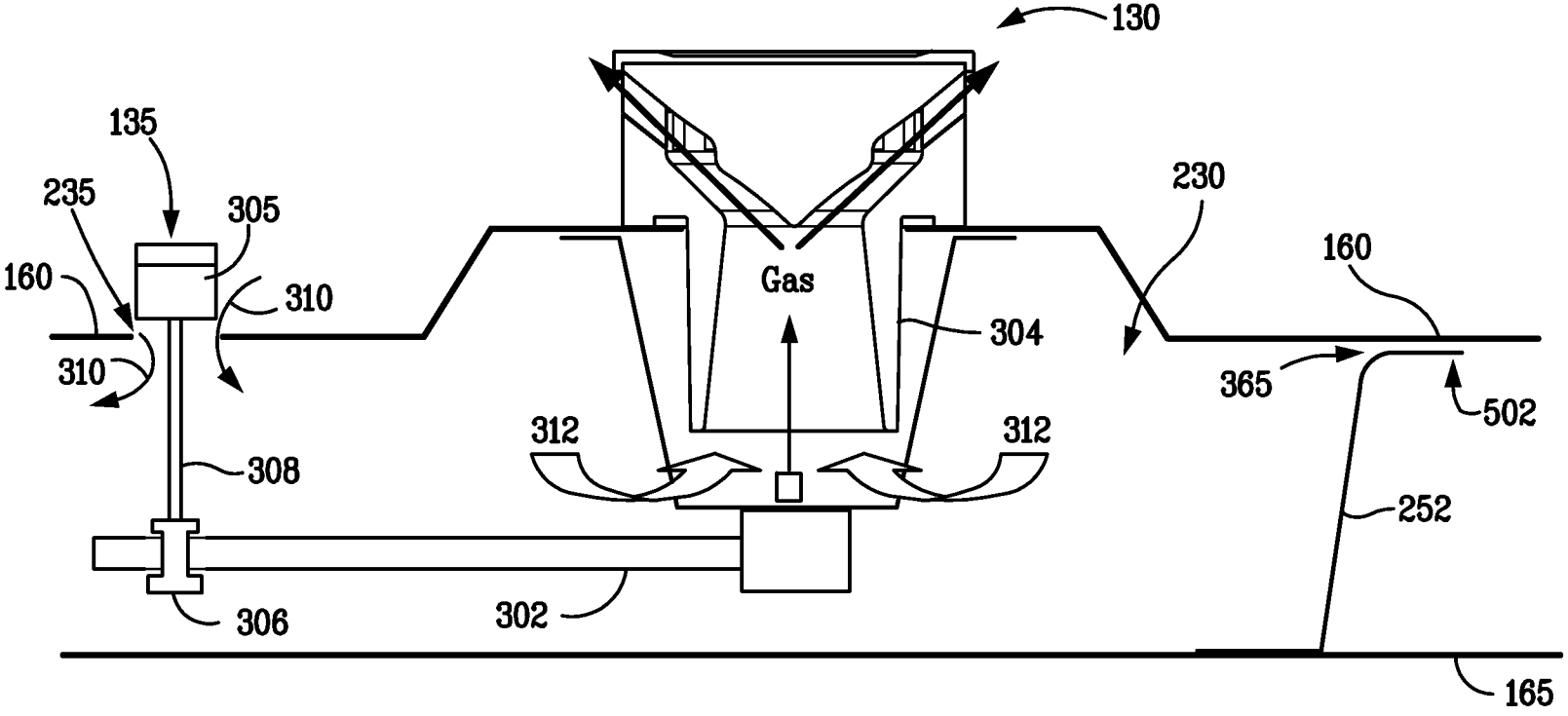
FIG. 3 depicts a cross sectional schematic diagram of a burner box and burner assembly in accordance with an embodiment of the present disclosure.

In the embodiment shown in FIG. 1, the gas cooktop 100 includes four gas fueled cooking elements or burners, generally referenced as burners 110, 120, 130, 140. In alternate embodiments, the cooktop 100 can include any suitable number of burners, other than four. The cooktop 100 further includes four controls 115, 125, 135, 145 associated with each of the burners 110, 120, 130, 140. Although the controls 115, 125, 135, 145 are shown as knob style controls in FIG. 1, in alternate embodiments, the controls may include any suitable mechanism to regulate the flow of gas to a burner, other than including a knob style control. Typically, each of the burners 110, 120, 130, 140 is connected by a gas line 302, as shown in FIG. 3, which is coupled to the burner input assembly 304, as will be appreciated and understood by one of ordinary skill in the art. Each of the controls 115, 125, 135, 145 is generally configured to regulate the gas input to each burner 110, 120, 130, 140, and therefore the heat output of each associated burner, as is generally known in the art. As is shown in FIG. 1, each burner 110, 120, 130, 140 extends generally upwards through an opening in a top surface 160 of cooktop 100, and a grate assembly 150 is positioned over each burner for supporting a cooking utensil. The arrangement of the gas burners 110, 120, 130, 140 and control knobs 115, 125, 135, 145 shown in FIG. 1 is merely exemplary, and in alternate embodiments, the positioning and layout of the burners relative to the control knobs can be in any desired orientation. For example, the controls 115, 125, 135, 145 could be positioned on the left or front of the cooktop 100.

Figure 2:
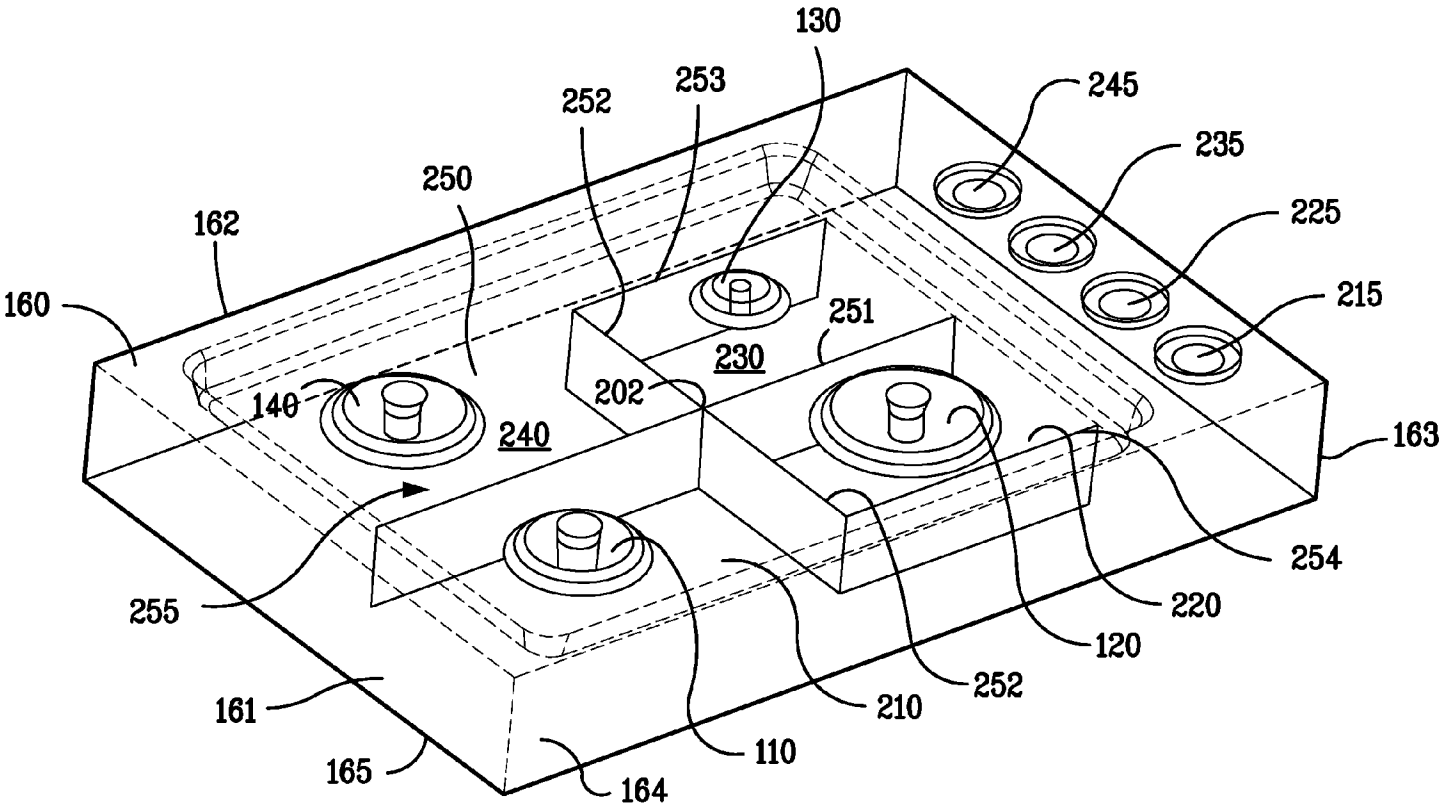
FIG. 2 depicts a schematic top perspective view of a gas cooktop in accordance with an embodiment of the present disclosure.

Generally, air is supplied to the cooktop 100 through distinct openings in the cooktop 100 or via clearances associated with a control knob clearance orifice associated with each control 115, 125, 135, 145. FIG. 2 illustrates one embodiment of a schematic top perspective view of the cooktop 100, where air is supplied through control knob clearances. As shown in FIG. 2, the cooktop 100 includes one or more control knob clearance orifices 215, 225, 235, and 245. Each control knob clearance orifice 215, 225, 235, 245 generally comprises an opening in the cooktop 100 that is configured to allow passage of a valve stem of an associated control valve, an example of which is shown in FIG. 3. FIG. 3 illustrates a cross-sectional view of the burner input assembly 304 including burner 130 and control 135. As is shown in FIG. 3, the control 135 generally comprises a valve 306 coupled to a knob 305 by a valve stem 308. The valve stem 308 extends from the valve 306 through the opening 235 in a top surface 160 of the cooktop 100 where it is coupled to the knob 305 in a suitable manner. The opening 235 is generally larger than shaft 308, thereby providing an opening, or clearance, to allow the introduction of air (depicted generally by flow lines 310). In response to opening of the valve 306, gas will flow, via gas line 302 to burner 130. As will be appreciated by one of skill in the art, the flow of gas through the burner 130 creates a vacuum to draw air 312 from the burner box 230.

As is shown in FIG. 2, a burner box assembly 250 includes a partition assembly 255 with one or more partitions 251-254. In the embodiment shown in FIG. 2, the partition assembly 255 is configured in the shape of a fork, with the open ends in a direction of the air intakes 215, 225, 235, 245. In alternate embodiments, the partition assembly 255 can comprise any suitable configuration that provide segregated airflow pathways to the different burners, other than including a fork configuration.

Accordingly, the partition assembly 255 may define one or more distinct burner zones, such as distinct burner boxes 210, 220, 230, 240 beneath the top surface 160 of the cooktop 100. Each orifice 215, 225, 235, 245 generally provides an inlet for air into each respective distinct burner box 210, 220, 230, 240. As is shown in FIG. 2, the burner box assembly 250 generally includes four distinct burner boxes 210, 220, 230, 240, each associated with a respective burner 110, 120, 130, 140 to provide an isolated air intake path from an orifice 215, 225, 235, 245 to the respect burner 110, 120, 130, 140.

In one embodiment, the partition assembly 255 includes a main member 251, cross member 252 and respective side members 253 and 254. Side members 253 and 254 are coupled to the main member 251 by the cross member 252. In one embodiment, the partition assembly 255 may comprise separate structural components added to the cooktop 100. For example, the partition assembly 255 may be attached to the cooktop 100 top surface 160. In another embodiment, the partition assembly 255 may be attached to a bottom surface 165 of the cooktop 100.

In one embodiment, main member 251 extends generally lengthwise along a center of the burner box assembly 255 from the left side 161 to the right side 163 of the cooktop 100, and from the bottom surface 165 to the top surface 160. The cross member 252 is positioned widthwise along an approximate midline 202 of the burner box assembly 250, and extends for a distance that is suitable to encompass an area around each burner 120, 130. The cross member 252 is approximately bisected by and coupled to the main member 251. The side members 253, 254 are coupled to ends of the cross member 252 and positioned to leave a suitable air pathway between an inner surface of each outer wall 162, 164 and the respective partition side member 253, 254. Partition cross member 252, as well as side members 253, 254, also extend or bridge the distance from the bottom surface 165 to the top surface 160 of the cooktop 100 so that when the top 160 of the cooktop 100 is in place, a seal is formed between the partition members 251-254 and the bottom and top surfaces of the cooktop 100. The seal is substantially air tight and is configured to separate the air flow paths of the cooktop 100. Although partition members 251 and 252 are shown as single pieces, in alternate embodiments, the members 251 and 252 can comprise any suitable number of members. In one embodiment, the partition assembly 255 can be formed from one or more partition members.

The arrangement of the partitions 251-254 in the burner box assembly 250 generally defines and isolates the intake flow path and reduces interference of the flow paths among the burners 110, 120, 130, 140. The path definition and isolation from the orifices 215, 225, 235, 245 to the respective individual burners 110, 120, 130, 140 increases a likelihood that each burner 110, 120, 130, 140 obtains air via a segregated, distinct pathway. Provision of such segregated, distinct pathways reduces an influence of operational settings between the burners. For example, one burner may provide stable operation at its lowest rating while multiple other burners are used at their maximum rating.

Figure 4:
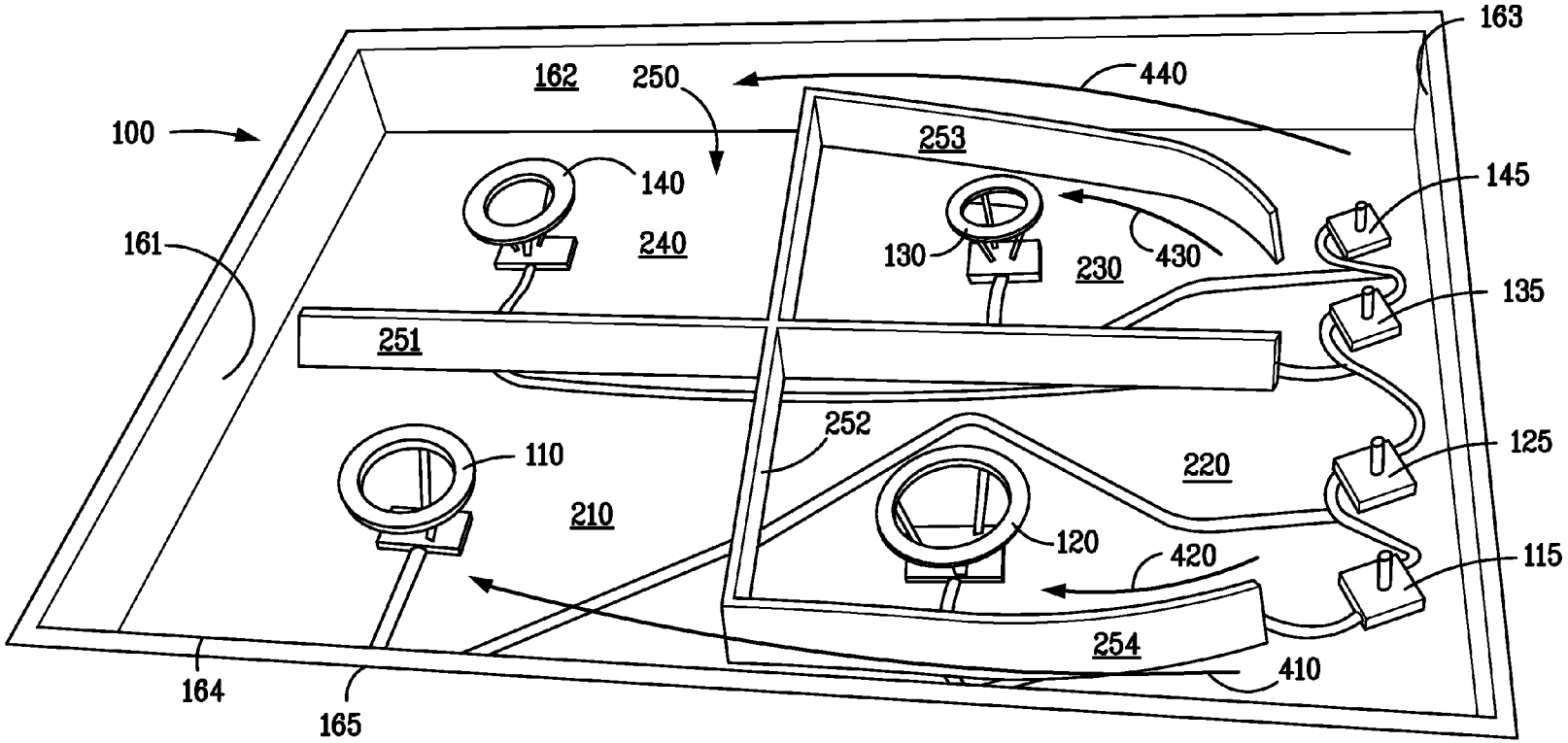
FIG. 4 illustrates a perspective view of a gas cooktop incorporating aspects of the disclosed embodiments with a top cover removed.

FIG. 4 depicts a perspective view of an embodiment of the cooktop 100 with the top surface 160 removed, exposing the burners 110, 120, 130, 140, controls 115, 125, 135, 145, and partition members 251-254. The four side surfaces 161-164 and bottom 165 of the cooktop 100 define the outer periphery of the burner box assembly 250. The partition members 251-254 are disposed such that air entering the burner box assembly 250 through each control clearance orifice 215-245 is directed to a corresponding one of the distinct burner boxes 210, 220, 230, 240 along air pathways 410, 420, 430 and 440, respectively.

It is contemplated that the benefits of distinct air pathways result from each partition member 251-254 of the partition assembly 255 having a height that substantially bridges the gap between the top surface 160 and bottom surface 165. As used herein with regard to the height of the partition members, the term "substantially" shall indicate that the height of the partition member is sufficient to segregate or distinguish the air pathways. That is, in some embodiments, the benefits of distinct air pathways may be provided even if the members 251-254 of the partition assembly 255 do not completely bridge the distance between the cooktop 100 top surface 160 and bottom surface 165. For example referring to FIG. 3, a small space, such as a gap 365, may be formed between the top portion 502 of partition member 252 and the cooktop 100 top surface 160. It will be appreciated that a similar gap may result between the each partition member 251-254 of the partition assembly 255 and the cooktop 100 bottom surface 165.

Figure 5:
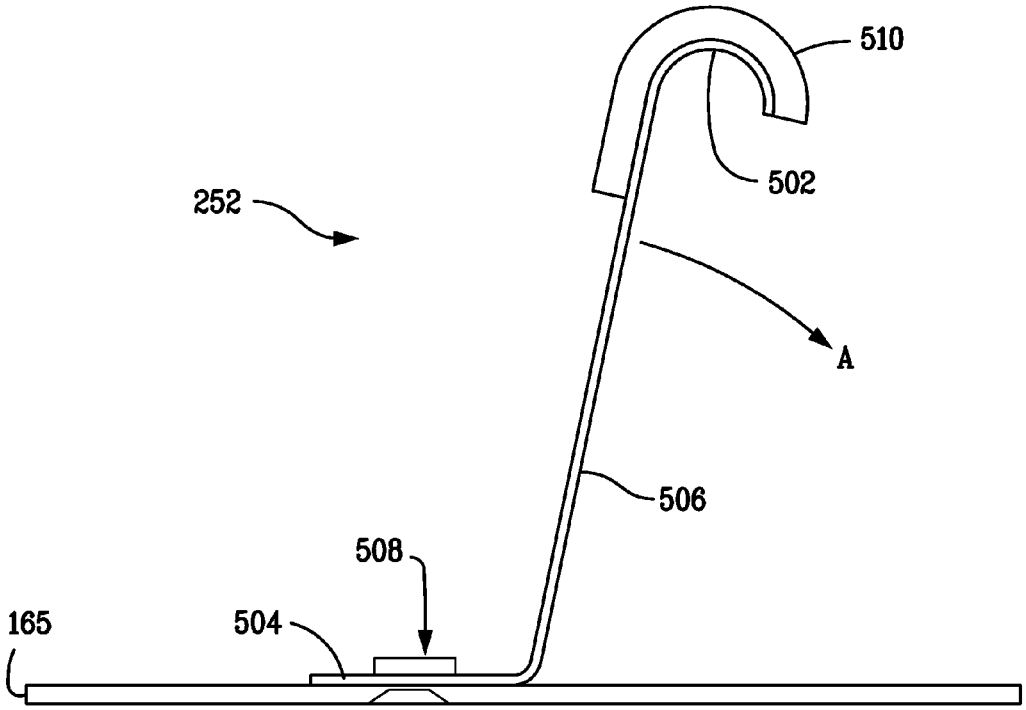
FIG. 5 is a side view of a partition member of the disclosed embodiments.

FIG. 5 illustrates a side view of exemplary partition member 252. While only partition member 252 is referred to in this example, this is for descriptive purposes only, and the description similarly applies to partition members 251, 253 and 254. In this example, the partition member 252 comprises a top portion 502, bottom portion 504 and middle portion 506. The partition member 252 is configured to be mechanically attached to one or both of the top surface 160 and bottom surface 165 of the cooktop 100. In this example, the bottom portion 504 is shown to be mechanically affixed to the bottom 165 of the cooktop 100 using a fastener 508. In alternate embodiments, the attachment mechanism can comprise any suitable attachment device or method, including for example a rivet, threaded fastener, adhesive, or clinching.

In one embodiment, the partition members 251-254 may be made of sheet metal. In other embodiments, the partition members 251-254 may be made of other suitable materials, such as thermosets, polymers, composites, or other engineered material to direct the airflow as described herein.

The top portion or end 502 of the partition member 252 is generally configured to engage an underside of the top surface 160 of the cooktop 100. In one embodiment, the engagement of the top end 502 with the underside of the top surface 160 is configured to provide a seal to prevent a flow of air between the mating surfaces of the end 502 and underside of portion 160. The partition member 252 may be configured to be flexible so that the member can bend slightly when the top surface 160 is mated against the top end 502. As shown in FIG. 5, the partition member 252 is slightly angled away from a vertical orientation. When the top surface 160 of the cooktop 100 is mated against the top end 502 of the partition member 252, the top end 502 and middle portion 506 can move in the direction A, approximately parallel to the plane of the top surface 160. This provides a sealing engagement between the mating surfaces of the top surface 160 of the cooktop 100 and the top end 502 of the partition member 252.

In one embodiment, as shown in FIG. 5, the top end 502 of the partition member 252 includes a material 510, such as a foam, elastomeric pad, or other temperature resistant fabric that will aid in forming the seal. As used herein, the term "temperature resistant" shall indicate a fabric that is capable of withstanding temperatures contemplated within a gas cooktop, of approximately at least 500 degrees Fahrenheit. The material 510 can be adhesively applied to the top end 502 and may function to enhance the interface between the mating surfaces of the top end 502 and the top surface 160 of the cooktop 100. In one embodiment, the material 510 may also be configured to provide a vibration dampening and noise dampening.

Figure 6:
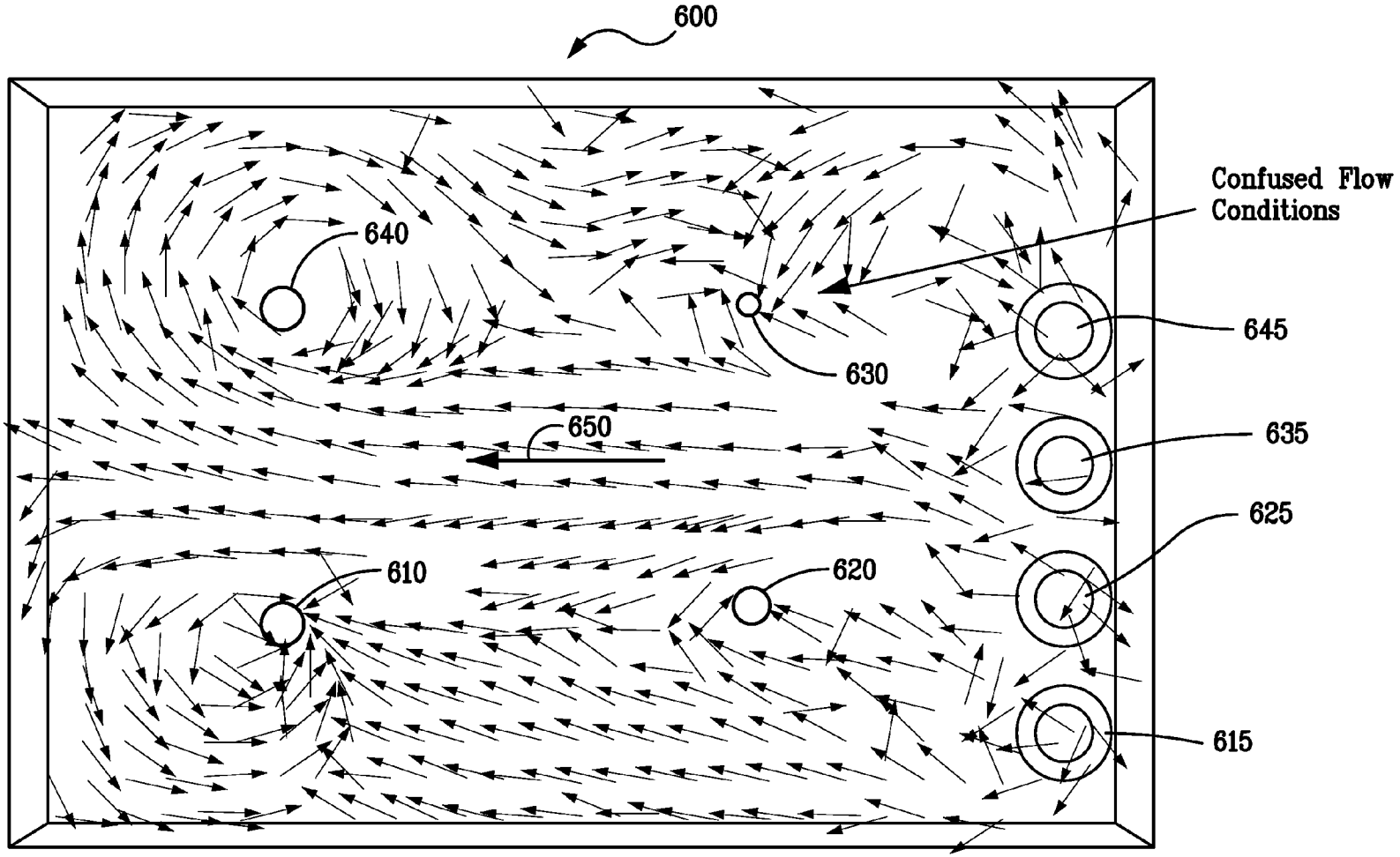
FIG. 6 is a schematic air flow diagram for a cooktop without a partition assembly.
Figure 7:
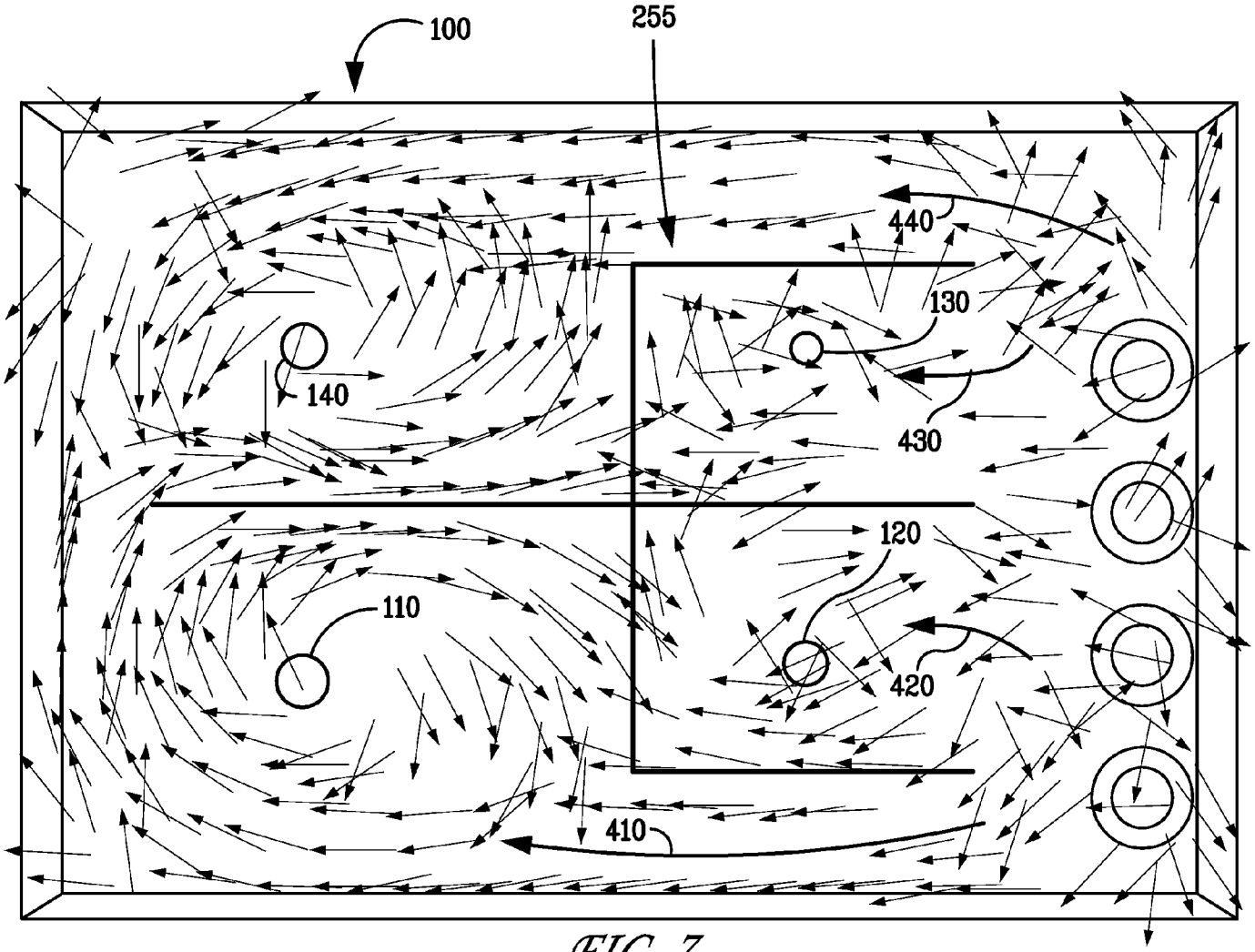
FIG. 7 is a schematic air flow diagram for a cooktop incorporating aspects of the disclosed embodiments.

FIGS. 6 and 7 are graphs illustrating general air flow conditions in a cooktop 600 without partitions (FIG. 6) and a cooktop 100 including the partition assembly 255 (FIG. 7). As is shown in FIG. 6, the cooktop 600 does not include a partition assembly. Air is drawn into the cooktop 600 from around the air intake openings 615-645. The air flow pattern 650 from the intake openings and in and around each of the burners 610-640 is in a generally confused state, with the same general flow pattern 650 feeding, or providing air, to each of the burners 610-640. The air intake paths for each of the burners 610-640 are shown crossing other burner air intake paths. This generally results in interference in the air flow paths and intake. However, as shown in FIG. 7, where a partition assembly 255 is used to segregate the airflow, the partition assembly 255 separates the airflow paths, creating or forming distinct and separate airflow paths 410-440. The airflow path definition and isolation of the disclosed embodiments generally enhances the intake air flow to each of the burners 110-140 and reduces interference between the different burners that results when there is no partition assembly 255 in place.

Although the cooktop 100 is shown and described as having air enter through control clearance orifices 215, 225, 235, 245, aspects of the disclosed embodiments are applicable to other cooktop arrangements, including but not limited to, other air inlets or orifices through which air may enter the burner box, such as vent openings, which may be disposed upon the cooktop top surface or side surfaces, for example. The aspects of the disclosed embodiments are therefore not intended to be limited to any particular type or configuration of cooktop air inlet.

As disclosed, some embodiments of the present disclosure may include advantages such as: increased stability of one gas burner at low heat setting while other burners are at high heat settings; and enhanced stability of simmer burners in conjunction with gas burners having greater efficiency air intake venturis that may have an accumulated air intake rate of 250 cubic feet per hour.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas cooktop comprising;

a burner box assembly comprising a top surface, a bottom surface, and air inlets, wherein the top surface and the bottom surface form a plenum;

gas burners disposed through openings in the top surface, respectively;

controls in operative communication with the gas burners, respectively; and a partition disposed between the top surface and the bottom surface, the partition defining segregated air paths within the plenum, leading from the air inlets to the gas burners, wherein the partition is configured in the shape of a fork with open ends in a direction of air intakes, and the partition is positioned to leave an air pathway between an inner surface of each outer wall of the burner box assembly and the partition, and wherein each of the air inlets is configured to receive part of one of the controls and to introduce primary air to the gas burners.

2. The gas cooktop of claim 1, wherein the partition comprises a plurality of partition members.

3. The is cooktop of claim 1, wherein the burner box assembly further comprises a front surface and a back surface, and the partition comprises:

a main member disposed lengthwise approximately along a center of the burner box assembly;

a cross member approximately bisected by and coupled to the main member and disposed widthwise approximately along a midline of the burner box assembly, the cross member haying a first end and a second end opposite the first end, a distance from the cross member to the first and second ends suitable to encompass an area around a gas burner; and two side members, one side member coupled to the first end and the other side member coupled to the second end, the side members disposed lengthwise proximate the front surface and back surface, respectively, each side member and the respective front and back surface defining an air path therebetween.

4. The gas cooktop of claim 1, wherein the partition defines distinct burner boxes within the burner box assembly which correspond to one of the gas burners.

5. The was cooktop of claim 1, wherein:

a height of the partition is substantially equal to a distance between the top surface and the bottom surface.

6. The gas cooktop of claim 1, wherein:

the partition has a first end and a second end opposite the first end; and the first end of the partition is attached to at least one of the top surface and the botton surface.

7. The gas cooktop of claim 6, wherein:

the partition is attached via at least one of an adhesive, a rivet, a threaded fastener, and clinching.

8. The gas cooktop of claim 6, wherein:

a height of the partition is less than a distance between the top surface and the bottom surface, thereby defining a gap between the second end of the partition and the burner box assembly.

9. The as cooktop of claim 6, wherein:

the second end of the partition comprises at least one of foam, elastomeric pad, and temperature resistant fabric.

10. The gas cooktop of claim 9, wherein:

the second end of the partition is configured to deflect approximately parallel to the plane of the top surface when the second end of the partition is mated against the top surface.

11. The gas cooktop of claim 1, wherein each of the controls comprises a gas control valve in operative communication with a respective one of the gas burners.

12. The gas cooktop of claim 11, wherein each of the controls further comprises a valve stem in operative communication with a corresponding gas control valve and disposed through a corresponding air inlet.

13. The gas cooktop of claim 1, wherein the partition comprises sheet metal.

14. The gas cooktop of claim 1, wherein the partition comprises polymer material.

15. A gas cooktop comprising,:

a burner box assembly comprising a top surface, and a bottom surface, wherein the top surface and the bottom surface form a plenum;

gas burners disposed through openings in the top surface, respectively;

gas controls in operative communication with the gas burners, respectively;

control clearance orifices through the top surface, each control clearance orifice being configured to receive part of one of the gas controls; and a partition disposed between the top surface and the bottom surface, the partition defining segregated air paths within the plenum, leading from the control clearance orifices to the gas burners, wherein the partition is configured in the shape of a fork with open ends in a direction of air intakes, and the partition is positioned to leave an air pathway between an inner surface of each outer wall of the burner box assembly and the partition, wherein each of the control clearance orifices is configured to introduce primary air to the gas burners, and wherein a height of the partition is substantially equal to a distance between the top surface and the bottom surface of the cooktop.

16. The gas cooktop of claim 15, wherein each gas control comprises a stem passing through one of the control clearance orifices.

17. The gas cooktop of claim 15, wherein the partition comprises sheet metal.

18. The was cooktop of claim 15, wherein the burner box assembly further comprises a front surface and a back surface, and the partition comprises:

a main member disposed lengthwise approximately along a center of the burner box assembly;

a cross member approximately bisected by and coupled to the main member and disposed widthwise approximately along a midline of the burner box assembly, the cross member having a first end and a second end opposite the first end, a distance from the cross member to the first and second ends suitable to encompass an area around a gas burner; and two side members, one side member coupled to the first end and the other side member coupled to the second end, the side members disposed lengthwise proximate the front surface and back surface, respectively, each side member and the respective front and back surface defining an air path therebetween.

19. The gas cooktop of claim 15, wherein the partition defines a plurality of distinct burner boxes within the burner box assembly, each distinct burner box corresponding to one of the gas burners.

* * * * *

UNITED STATES PATENT AND TRADEMARK OFFICE

CERTIFICATE OF CORRECTION

PATENT NO. : 8,757,138 B2
APPLICATION NO. : 12/871297
DATED : June 24, 2014
INVENTOR(S) : Shaffer et al.

It is certified that error appears in the above-identified patent and that said Letters Patent is hereby corrected as shown below:

In the Claims

In Column 6, Line 35, in Claim 1, delete “comprising;” and insert -- comprising: --, therefor.

In Column 6, Line 56, in Claim 3, delete “is” and insert -- gas --, therefor.

In Column 6, Line 64, in Claim 3, delete “haying” and insert -- having --, therefor.

In Column 7, Line 10, in Claim 5, delete “was” and insert -- gas --, therefor.

In Column 7, Line 17, in Claim 6, delete “botton” and insert -- bottom --, therefor.

In Column 7, Line 26, in Claim 9, delete “as” and insert -- gas --, therefor.

In Column 7, Line 46, in Claim 15, delete “comprising,:” and insert -- comprising: --, therefor.

In Column 8, Line 26, in Claim 18, delete “was” and insert -- gas --, therefor.

Signed and Sealed this
Seventh Day of April, 2015

Michelle K. Lee

Michelle K. Lee
*Director of the United States Patent and Trademark Office*